United States Patent [19]

Smith

[11] 4,351,072

[45] Sep. 28, 1982

[54] SEMI-AUTOMATIC POOL COVER

[75] Inventor: Marc Smith, Compton, Calif.

[73] Assignee: Automatic Solar Covers, Inc., Compton, Calif.

[21] Appl. No.: 177,181

[22] Filed: Aug. 11, 1980

[51] Int. Cl.[3] ..... E04H 3/16; E04H 3/18

[52] U.S. Cl. ..... 4/503; 4/502

[58] Field of Search ..... 4/502, 503

[56] References Cited

U.S. PATENT DOCUMENTS

| | | | |
|---|---|---|---|
| Re. 25,078 | 11/1961 | McGuire | 4/502 |
| 2,898,607 | 8/1959 | McGuire | 4/502 |
| 2,958,872 | 11/1960 | Meyer, Jr. | 4/503 |
| 3,050,743 | 8/1962 | Lamb | 4/502 |
| 3,148,383 | 9/1964 | Bartolucci | 4/503 |
| 3,229,309 | 1/1966 | Knodel | 4/503 |
| 3,264,656 | 8/1966 | Clay et al. | 4/503 |
| 3,426,366 | 2/1969 | Bailey et al. | 4/502 |
| 3,520,004 | 7/1970 | Patnaude | 4/503 |
| 3,613,126 | 10/1971 | Granderath | 4/502 |
| 4,060,860 | 12/1977 | Lamb | 4/502 |

FOREIGN PATENT DOCUMENTS

| | | | |
|---|---|---|---|
| 2938496 | 4/1980 | Fed. Rep. of Germany | 4/502 |

*Primary Examiner*—Henry K. Artis

*Attorney, Agent, or Firm*—Charles H. Thomas

[57] ABSTRACT

A flexible tarpaulin is rolled about a drum mounted on an axle that is secured to a rigid deck by mounting brackets. A spring acting between the axle and the drum serves to retract the tarpaulin onto the drum. A releasable retraction lock may be used to prevent retraction. The tarpaulin has apertures spaced along its edges and a plurality of fasteners are employed having latching pins that extend through the apertures into anchors embedded in the deck to secure the tarpaulin over the pool.

6 Claims, 6 Drawing Figures

SEMI-AUTOMATIC POOL COVER

BACKGROUND OF THE INVENTION

1. Field of the Invention

The present invention relates to protective covers for swimming pools.

2. Description of the Prior Art

Swimming pool covers have been employed for quite some time as a measure of reducing the extent to which leaves, twigs, and blowing debris collect in a swimming pool. By protecting the pool from airborne contaminants in this fashion when the pool is not in use, the necessary frequency of cleaning the pool is reduced. Pool covers are also employed as safety devices to prevent small children from inadvertently falling into a pool and drowning. Pool covers also serve as a means of conserving energy. The placement of a cover over a swimming pool reduces thermal loss from a pool both at night and on cool days, whether the pool employs an active heating plant, or whether it is only passively heated by the sun.

Conventionally swimming pool covers have been inordinately sophisticated, complex and expensive. Conventional pool covers are wound on powered rollers which are driven by an electric motor through a cable system to retract the pool cover onto a drum, or to withdraw the pool cover and extend it laterally outward to cover the surface of the pool. In conventional systems, the edges of the pool cover are provided with enlarged beads or other guides which ride in tracks that extend along the sides of a pool. The track system can either be installed on the deck of the pool, below grade along the upper edge of the side of the pool, or on the underside of a ledge that overhangs the pool. When such track systems are installed on the pool deck, they present unslightly upward projections. Leaves and other debris tend to collect in the structure of the tracks, and the tracks themselves present hazzards to users of the pool who are quite likely to stub their toes or otherwise injure their bare feet on the tracks. When the tracks are installed along the vertical sides of the pool at the upper edges thereof, they present hazzards to swimmers entering and obstructions to users leaving the pool. When the tracks are installed on the undersides of overhanging ledges, they are extremely expensive to install, very difficult to service, and such installations can only be performed for existing or newly constructed ledges, which are themselves quite expensive and space consuming. Furthermore, the track systems for conventional pool covers can only be employed on pools which are shaped with parallel sides unless the tracks are placed above grade on the deck.

Other swimming pool covers do not employ tracks, but rather utilize floats or covers constructed in rigid sections which float upon the surface of the water. While the disadvantages of the track systems are avoided, floating pool covers have their own drawbacks. Specifically, leaves, twigs, branches, papers and other debris fall onto the surface of the cover and are frequently dumped into the pool over the edges of the cover when the cover is withdrawn. Consequently, such covers are largely ineffective in preventing contamination of the pool. Furthermore, floating covers do not provide good protection for the safety of small children, and indeed, may well be more dangerous than no cover at all, since youngsters can fall into the pool at the edges of the covers and become entrapped beneath the floating cover.

SUMMARY OF THE INVENTION

The present invention is a semi-automatic pool cover which dispenses with the expensive electrical drive systems, employing motors, clutches and the like which are characteristic of prior art pool covers. By obviating the need for electrical power in the vicinity of the pool, the pool cover also eliminates a safety hazzard since faulty grounds and electrical shocks in a wet environment can no longer occur. Nevertheless, the pool cover of the present inventin does aid the user in retracting a flexible, tarpaulin cover onto a drum. To this end, a biasing spring is interposed between a rotatable drum upon which the tarpaulin is wound and a fixed axle about which the drum rotates. Manual withdrawal of the tarpaulin from the drum winds the spring to exert tension on the tarpaulin, tending to rewind it onto the drum.

In the preferred embodiments of the invention, the drum is equipped with a releasable retraction lock, such as a circular ratchet and pawl, that prevents retraction of the tarpaulin onto the drum, unless the pawl is disengaged from the ratchet. The retraction lock is normally engaged as the tarpaulin is unrolled, so as to prevent the tarpaulin from being rewound. When it is desired to rewind the tarpaulin onto the drum, the retraction lock is disengaged and the spring aids in rewinding the tarpaulin onto the drum.

The present invention also provides means for securing the edges of the tarpaulin to the pool deck without the provision of unslightly and expensive tracks. The edges of the tarpaulin of the invention are perforated at spaced intervals, and a plurality of fasteners are provided, one at each aperture. Each fastener includes a latching pin and a corresponding anchor. The anchor is embedded in the pool deck at a location corresponding to the position of an aperture when the tarpaulin is extended from the drum. The anchors are entirely below grade in the deck, and are quite small an innocuous. The latching pins typically are equipped with a head from which a bail extends to facilitate handling, and a shank with some latching mechanism thereon extending from the head. The shank is inserted through an aperture in the tarpaulin and into an anchor, so that the latching in head holds the tarpaulin close to the pool deck. The latching pin is twisted by means of the bail to lock the latching mechanism to the corresponding anchor. The flexible tarpaulin can thereby be fastened along its edges to cover pools of any irregular configuration. The latching pins are inserted and locked with a smooth, easy movement, and are just as easily withdrawn by a slight twist in the opposite direction when it is desired to remove the cover.

The semi-automatic pool cover of the invention has both an assisted retraction and rewinding mechanism, and edge fasteners to hold the tarpaulin in position without the unnecessary expense, bulk and sophistication of conventional pool cover systems.

The invention may be described with greater clarity and particularity by reference to the accompanying drawings.

DESCRIPTION OF THE EMBODIMENT

Figure 1:
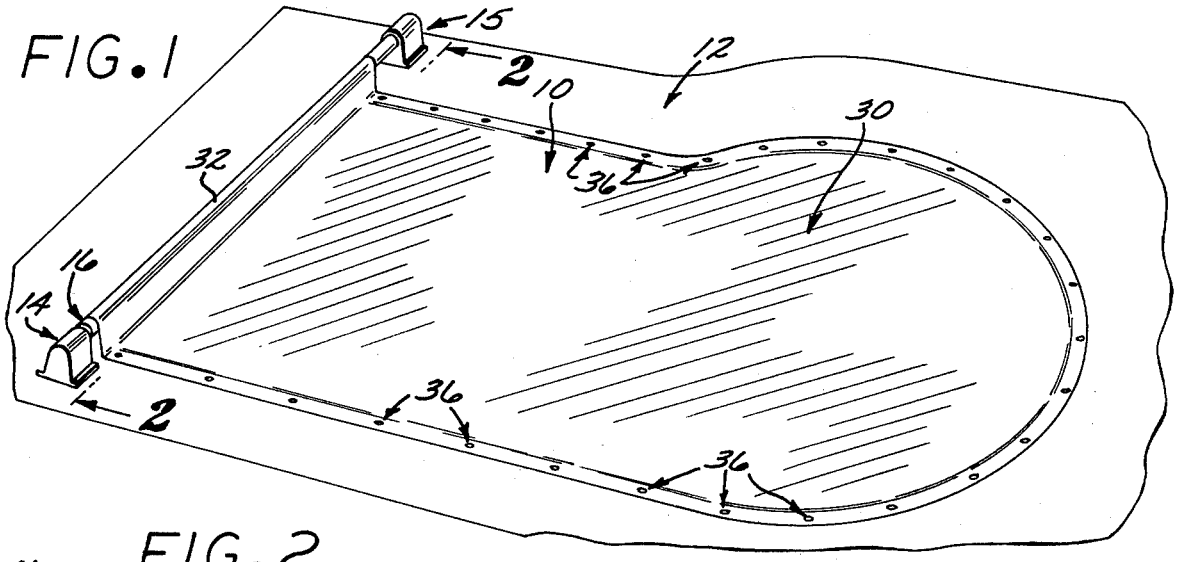
FIG. 1 is a perspective view of a pool cover of the invention in position covering an irregular shaped pool.
Figure 2:
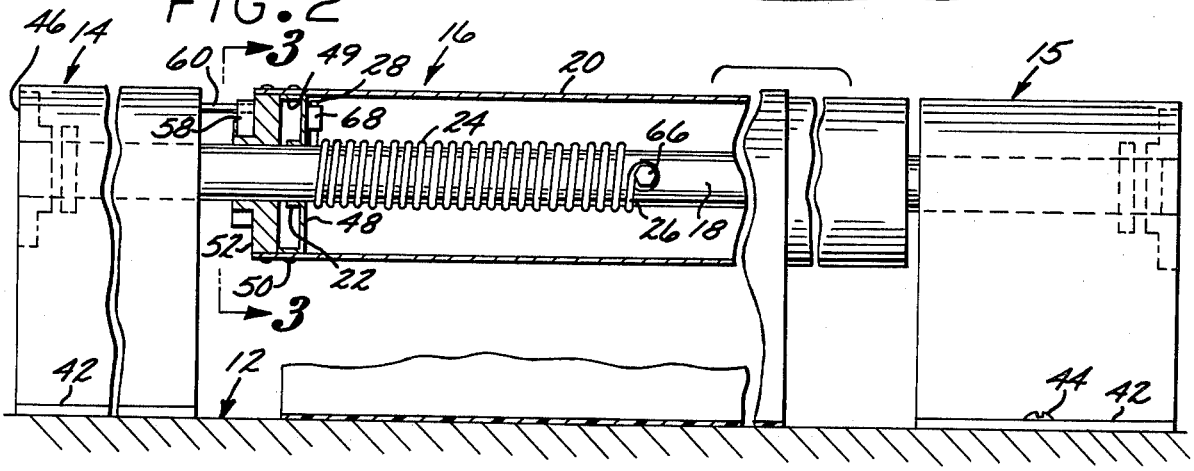
FIG. 2 is an elevational view, partially in section, and partially broken away taken along the lines 2—2 of FIG. 1.
Figure 5:
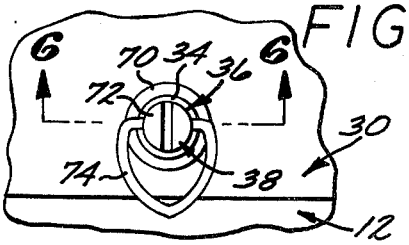
FIG. 5 is a top plan detail showing one of the edge fasteners of the pool cover.
Figure 6:
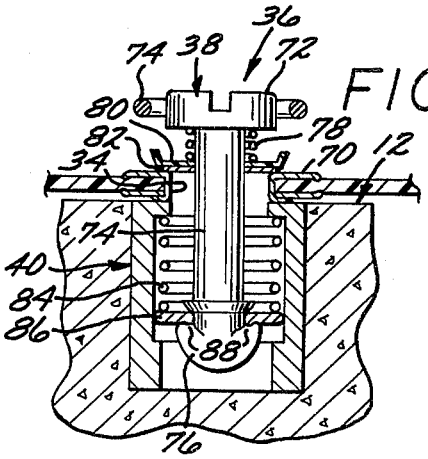
FIG. 6 is a sectional elevational view taken along the lines 6—6 of FIG. 5.

FIG. 1 illustrates a pool cover 10 for placement over a pool of water having an irregular shaped perimeter and surrounded by a rigid deck 12, constructed of concrete or tile. Mounting brackets 14 and 15 are spaced apart from each other in mutually facing disposition and secured to the deck 12 at one end of the pool, as illustrated in FIG. 1. The spacing between the mounting brackets 14 and 15 is at least a distance equal to the width of the pool as measured parallel to the alignment of the mounting brackets 14 and 15. A tubular roller 16 has an elongated axle 18, which is a solid aluminum or steel shaft secured at both ends to the mounting brackets 14 and 15, as depicted in FIG. 2. A right cylindrical drum 20 is concentrically disposed about the shaft 18 and is rotatably mounted thereon, also as illustrated in FIG. 2. A helically wound coil spring 24 is mounted on the axle 18 within the drum 20 in concentric annular disposition relative to the axle 18. The spring 24 is secured at one end 26 to the axle 18 and at the other end 28 to the drum 20 to bias the drum 20 toward a retracted position. A flexible, laminar tarpaulin 30, having a configuration corresponding to the shape of the pool, is secured at one edge 32 to the drum 20. The tarpaulin 30 can thereby be rolled up onto the drum 20, or laterally extended therefrom when withdrawn as illustrated in FIG. 1. Spaced apertures 34 are defined in the edges of the tarpaulin 30, except at the edge 32, to receive a plurality of fasteners 36 as depicted in FIGS. 1, 5 and 6. The fasteners 36 each have a fastening pin 38 for insertion into the apertures 34 and a cylindrical annular anchor 40, permanently embedded in the structure of the deck 12.

The mounting brackets 14 and 15 are both formed of molded fiberglass generally in the shape of a rounded triangular prisms with laterally extending base mounting flanges 42. The mounting flanges 42 are secured to the deck 12 by means of concrete or tile anchor bolts 44, as depicted in FIG. 2. Both of the mounting brackets 14 and 15 have horizontally axially aligned apertures therein raised above the deck 12 to receive the ends of the axle 18. Bushings 46 in the outwardly facing ends of the mounting brackets 14 and 15 secure the ends of the axle 18 in immobile engagement in the mounting brackets 14 and 15.

The roller 16 is illustrated in detail in FIG. 2 and has metal disk-like partitions 48 with turned over outer cylindrical edges 49 that are secured by screws 50 to the cylindrical drum 50. At their centers the partitions 48 are perforated and have turned over annular sleeves 22 which ride upon the surface of the axle 18. The partitions 48 serve as stiffeners to maintain coaxial alignment between the drum 20 and the axle 18.

As depicted in FIG. 2, the coil spring 24 is secured at its end 26 to the axle 18 by a hex-head screw 66 directed radially into the axle 18. At its opposite end 28, the spring 24 is secured to a partition disk 48 by a lock fastener 68. When the tarpaulin 30 is withdrawn to the disposition of FIG. 1, the coil spring 24 is tightly wound and exerts a force between the fixed axle 18 and the rotatable drum 20 which tends to rotate the drum 20 counterclockwise, as viewed in FIGS. 3 and 4.

Figure 3:
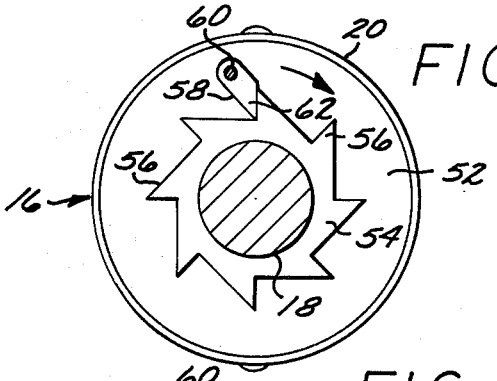
FIG. 3 is an end sectional elevational view taken along the lines 3—3 of FIG. 2 showing the retraction lock of the invention during tarpaulin withdrawal.
Figure 4:
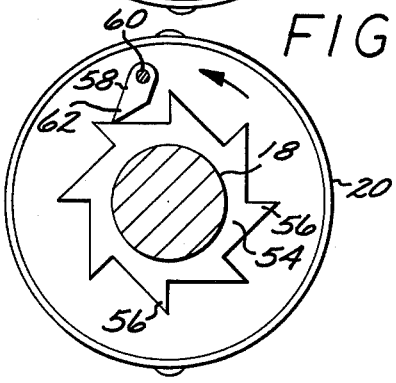
FIG. 4 is a sectional elevational view corresponding to the view of FIG. 3 showing the retraction lock during tarpaulin retraction.

At the ends of the drum 20 there are disk-shaped end plugs 52 which are constructed of molded urethane. At least one of the end plugs 52 is formed with a ratcheted gear 54 extending axially therefrom toward the mounting bracket 14. The ratcheted gear 54 is illustrated in FIGS. 3 and 4 and has teeth 56 thereon which are configured for engagement with a pawl 58 to prevent retrograde movement of the ratched gear 54, when the pawl 58 is flipped to the disposition depicted in FIG. 3. The pawl 58 is carried by a pin 60 which extends inwardly from the mounting bracket 14 toward the roller 15, as depicted in FIG. 2.

When the pawl 58 is moved to the disposition indicated in FIG. 3, the drum 20 will turn clockwise under tension manually exerted on the tarpaulin 30 as the tarpaulin 30 is withdrawn from the roller 16. The clockwise rotation of the drum 20 carries the end plug 52 and the ratchet gear 54 formed thereon in clockwise rotation as depicted in FIG. 3. The teeth 56 of the ratchet gear 54 cam the pawl 58 outwardly away from the axle 18 to allow clockwise rotation of the ratchet gear 54. Should tension be released on the tarpaulin 30, however, the spring 24 is not allowed to retract the tarpaulin 30 onto the drum 20, since the nose 62 of the pawl 58 will engage with an abutting face of one of the teeth 56 on the ratchet gear 54 to prevent retrograde motion.

When it is desired to rewind the tarpaulin 30 onto the roller 16, the pawl 58 is flipped manually from the engaged disposition depicted in FIG. 3 where it opposes the bias of the spring 24 to the disengaged disposition depicted in FIG. 4, where it allows retraction of the tarpaulin 30 onto the drum 20 with the assistance from the force of the spring 24. Manipulation of the pawl 58 is achieved by rotating the pawl 58 counterclockwise about the pin 60 from the disposition of FIG. 3 to the disposition depicted in FIG. 4. When the pawl 58 is disposed in this fashion, the force of the spring 24 is not opposed and serves to aid retraction and rewinding of the tarpaulin 30 onto the roller 16. When the pawl 58 is disengaged from the ratchet gear 54, as depicted in FIG. 4, the spring 24 rotates the drum 20 counterclockwise relative to the axle 18, thereby rolling up the tarpaulin 30 onto the drum 20. When the pawl 58 is disposed as depicted in FIG. 4, the teeth 56 of the ratchet gear 54 merely cam the pawl 58 away from the axle 18 as the drum 20 rotates counterclockwise.

The fasteners 36 are illustrated in detail in FIGS. 5 and 6. Each aperture 34 in the tarpaulin 30 is reinforced with an annular brass grommet 70, as depicted in FIGS. 5 and 6. Each latching pin 38 has a head 72 with a bail 74 thereon. The bail 74 protrudes outwardly from the upper surface of the tarpaulin 30 to facilitate manual manipulation of the latching pin 36. A shank 74' on each latching pin 38 extends from the head 72 into the aperture 34 and terminates in a spear head shaped tip 76 having flanges 88, as depicted in FIG. 6. A light coil spring 78 is located about the shank 74' just below the head 72 and bears against the underside of the head 72 and against an annular plastic collar 80. The collar 80 is disposed about the shank 74 and has a turned up outer rim. A brass washer 82 is located about the shank 74' on the side of the collar 80 opposite the spring 78. The brass washer 82 bears against the grommet 70 when the fastener 36 is latched.

The anchor 40 of each fastener 36 has an internally threaded well 84 and includes at its lower portion a transverse latching plate 86 with a slot therein that is adapted to receive the spear head tip 76 on the shank 74' when the tip 76 is aligned with the slot in the latching plate 86.

To fasten the edge of the tarpaulin 30 to the deck 10, the latching pins 38 are inserted into the apertures 34 in the tarpaulin 30. The shanks 74' of the latching pins 38 are directed into the wells 84 defined within the anchors 40, and the head 72 of each fastening pin 38 is pressed downwardly against the spring 78 and twisted by means of the bail which serves as a grip 74 until the spear head tip 76 on the shank 74' passes through the slot in the latching plate 86. This can be sensed by the person inserting the fastening pin 38, since the head 72 will abruptly fully compress the spring 78 when the spear head tip 76 and the slot in the latching plate 86 are aligned. The user then merely twists the head 72 by the bail 74 one quarter turn so that the flanges 88 of the spear head tip 76 bear against the underside of the latching plate 86, since those flanges are no longer aligned with the slot therein. The force of the compression spring 78 urges the washer 82 to bear against the grommet 70 to hold the tarpaulin 30 snugly against the deck 12, and also to hold the flanges 88 of the spear head tip 76 in abuttment against the underside of the latching plate 86. In this fashion the fastening pins 38 are releasably engaged with the anchors 40 to thereby secure the tarpaulin 30 to the deck.

To release the fastening pin 38, a user merely depresses the latching pin head 72 slightly so as to dislodge the flanges 88 from contact with the latching plate 86. The user then twists the head 72 one quarter turn in the opposite direction so that the spear tip 76 is once again aligned with the slot in the latching plate 86. The spring 78 will thereupon push the head 72 upwardly, thereby pulling the spear tip 76 outwardly, and the latching pin 38 can thereupon be removed from the anchor 40. When all of the latching pins 38 have been removed from the anchors 40, all of the fasteners 36 are disengaged, and the tarpaulin 30 can be rewound onto the drum 20 by positioning the pawl 58 as depicted in FIG. 4. The user merely guides the tarpaulin 30 onto the roller 16 as the spring 24 rewinds the tarpaulin 30 onto the drum 20.

Undoubtedly variations and modifications of the invention will become readily apparent to those familiar with swimming pool covers. However, the scope of the invention should not be construed as limited to the specific embodiment depicted, but rather is defined in the claims appended hereto.

I claim:

1. A pool cover for placement over a pool of water surrounded by a rigid deck comprising:

mounting brackets spaced apart from each other and secured to said deck along the sides of said pool, a tubular roller having an axle fixedly secured at both ends to said mounting brackets, a drum rotatably mounted on said axle, and a spring acting between said axle and said drum to bias said drum to a retracted position, a flexible, laminar, tarpaulin secured at one edge to said drum for rolled storage thereon and having an opposite free edge for lateral extension for use when withdrawn from said roller and defining spaced apertures within its perimeter at the edges thereof which are not secured to said drum, whereby withdrawal of said free edge of said tarpaulin from said roller deflects said spring to increase the force of its bias, a unidirectional racket and pawl interposed between at least one of said mounting brackets and said drum and manually movable to an engaged position opposing the bias of said spring and preventing retraction of said tarpaulin while allowing the free withdraw of said tarpaulin from said drum against the bias of said spring, and to a disengaged position to allow retraction of said tarpaulin onto said drum as well as free withdrawal of said tarpaulin from said drum, and a plurality of fasteners each having a downwardly extending projection adapted for insertion into said apertures in said tarpaulin and an upwardly extending grip engageable by the fingers of a user, and a plurality of anchors embedded in said deck at locations corresponding to the position of aperatures within the perimeter of said tarpaulin when said tarpaulin is extended from said drum, wherein said anchors are adapted to receive said downwardly extending projections in releasable latching engagement therewith and said fasteners are removable entirely from said anchors.

2. A pool cover according to claim 1 further characterized in that said downwardly extending projection of each fastener is a pin and the grip of each fastener includes a head with a bail thereon.

3. A pool cover according to claim 2 further characterized in that said pin and said anchor define a twist latching means that holds said pin in said anchor when said head is twisted in one direction and releases said pin from said anchor entirely when said head is twisted in the opposite direction and lifted from said anchor.

4. A pool cover according to claim 1 further characterized in that said spring is a coil spring disposed annularly about said axle and secured thereto at one end and secured to said drum at an opposite end.

5. A pool cover for mounting on a rigid deck comprising:

a pair of mounting brackets disposed along sides of said pool and separated from each other by at least the width of said pool as measured parallel to the alignment of said mounting brackets, a horizontal roller having an axle secured to said mounting brackets, a drum spanning said width of said pool and rotatable upon said axle, a tarpaulin secured at one edge to said drum, and retractable onto said roller and having an opposite free edge withdrawable to extend laterally from said roller, and having apertures defined within the perimeter of said tarpaulin at the outer edges thereof, a spring biased retraction mechanism arranged for urging rotation of said drum in one direction relative to said axle to roll said tarpaulin onto said drum, a unidirectional releaseable retraction lock that when engaged prevents retraction of said tarpaulin onto said drum and allows withdrawal of said tarpaulin from said drum and when disengaged allows said retraction mechanism to urge said drum to rotate to roll said tarpaulin onto said drum as well as to allow free withdrawal of said tarpaulin from said drum against the bias of said retraction mechanism a plurality of anchors extending into said rigid deck about a portion of the perimeter of said pool of locations corresponding to the positions of said apertures in said tarpaulin, and a plurality of fasteners having downwardly extending projections for insertion through said apertures for releasable engagement with said anchors to thereby secure said tarpaulin to said deck and having upwardly extending means adapted to be gripped by the fingers of a user to effectuate insertion and removal of said downwardly extending projections relative to said anchors and said fasteners are entirely removable from said anchors.

6. A pool cover according to claim 5 further characterized in that said apertures in said tarpaulin are reinforced with grommets.

* * * * *